United States Patent [19]

Hedström et al.

[11] Patent Number: 4,734,172

[45] Date of Patent: Mar. 29, 1988

[54] METHOD FOR SELECTIVELY RECOVERING LEAD FROM COMPLEX SULPHIDIC NON-FERROUS METAL CONCENTRATES

[75] Inventors: Lars A. Hedström, Ursviken; Nils F. R. Lindström, Skelleftehamm; Kenneth A. S. Sjöberg, Boliden, all of Sweden

[73] Assignee: Boliden Aktiebolag, Stockholm, Sweden

[21] Appl. No.: 904,010

[22] Filed: Sep. 5, 1986

[30] Foreign Application Priority Data

May 9, 1985 [SE] Sweden ..... 8504140

[51] Int. Cl.[4] ..... C25C 1/14

[52] U.S. Cl. ..... 204/117; 204/128

[58] Field of Search ..... 204/117, 128

[56] References Cited

U.S. PATENT DOCUMENTS 3,673,061 6/1972 Kruesl ..... 204/117
4,204,922 5/1980 Fraser et al. ..... 204/105 R
4,381,225 4/1983 Everett ..... 204/117

FOREIGN PATENT DOCUMENTS

80/02164 4/1980 PCT Int'l Appl. .
84/02356 12/1983 PCT Int'l Appl. .

*Primary Examiner*—R. L. Andrews
*Attorney, Agent, or Firm*—Burns, Doane, Swecker & Mathis

[57] ABSTRACT

The invention relates to a method for selectively recovering lead from complex sulphidic non-ferrous metal concentrates in an electrolytic cell incorporating at least one anode and one cathode and an electrolyte containing chlorine ions, at a temperature beneath the boiling point of the concentrate-containing electrolyte and at a pH beneath 7. Sulphur present in the concentrate is converted substantially into elementary form, and at least the major part of the lead content passes into solution and is then precipitated selectively by cathodic processes. The invention is characterized in that the concentrate is slurried in an electrolyte having a chloride-ion strength above about 2 M, preferably in the range 3–5 M, to form a suspension which is caused to flow into contact with or adjacent the surface of anodes located in the cell; and in that the highest possible anodic current density considering required selectivity is maintained during the electro-winning process.

3 Claims, 2 Drawing Figures

METHOD FOR SELECTIVELY RECOVERING LEAD FROM COMPLEX SULPHIDIC NON-FERROUS METAL CONCENTRATES

The present invention relates to a method for selectively recovering lead from complex sulphidic non-ferrous metal concentrates in an electrolytic cell incorporating at least one anode and one cathode and an electrolyte which contains chloride ions, at a temperature beneath the boiling point of the concentrate-containing electrolyte and at a pH beneath 7, and the sulphur present in the concentrate being converted into elementary form and at least the major part of the lead content passing into solution and being subsequently precipitated out selectively through a cathodic process.

A method according to the introductory passage is described in No. EP-B-0 026 207 or the corresponding U.S. Pat. No. 4,381,225. This known method is a development of prior art hydrometallurgical processes, in which non-ferrous metals, including lead, are recovered by leaching and electro-winning processes in one and the same cell. Such prior art processes have been described, for example, in U.S. Pat. Nos. 3,673,061 and 4,204,922 and No. DE-C-27 32 817. In U.S. Pat. No. 3,673,061 it is proposed that the process is carried out at high anodic current densities to obtain a maximum recovery of the metal values present. Thus, this process results in a non-selective recovery of the non-ferrous metals present. A similar process is described in U.S. Pat. No. 4,204,922 with the use of a special cell construction which allows close contact between the concentrate suspension and the anode. It is stated in the specification to this patent, however, that the method cannot be applied in the case of mixed or composite sulphide minerals, and neither does the method enable complex sulphide material to be recovered selectively.

No. DE-C-27 32 817 discloses the selective recovery of lead from complex sulphide material, but requires first total leaching and then selective precipitation of the cations.

Therefore there is proposed in the aforementioned European Patent Publication No. EP-B-0 026 207 a method for selectively recovering lead from complex sulphide concentrates in which physical contact of the particles with the anodes is avoided to the greatest possible extent while, at the same time, limiting the current density to as low a level as possible, preferably between 50 and 100 A/m$^2$. It is true that this known method provides a high degree of selectivity, although at the price of low specific lead recovery, i.e. the quantity of lead recovered per unit area of anode, due to the necessary restriction of current density.

It has now surprisingly been found possible to provide for the recovery of lead from complex sulphide concentrates by a method in which good selectivity can be obtained when a high anode current density is used, resulting in more rapid leaching of the lead.

The main characterizing features of the invention are set forth in the following claims.

Thus, the complex sulphide concentrate charged to the process is collected in the electrolyte to form a suspension. The suspension formed in the electrolytic cell is caused to flow onto or closely adjacent to the surfaces of anodes located in the cell. By "surfaces" is meant here, and in the following, an electrochemically active surface of the anode.

The highest possible anodic current density is maintained during the recovery process. By "highest possible" is meant an anodic current density which will enable the highest possible quantities of lead to be recovered selectively without resulting in troublesome chlorine-gas emission from the cell. In order to maintain required selectivity with regard to the lead recovery, the anodic current density must not exceed a value at which the concentrate suspension present does not reduce the oxidation agent formed at the anode. Simultaneously a low oxidation potential must be maintained within the suspension in the cell. In this respect there is used in the majority of cases a lowest anodic current density of about 200 A/m$^2$. In the case of a continuous process, however, in which a plurality of cells are connected in series in a circuit, the level of current density cannot be as high in the last cells of the circuit, where the concentrates become progressively more depleted in lead. Normally, a current density of about 300 A/m$^2$ has been found to provide both the required selectively as the desired productivity per anode area unit. It is, however, within the scope of the invention to utilize even higher current densities, for example up to 400 A/m$^2$ and thereabove, provided an amount of lead sulphide great enough to consume the oxidation agent formed is present in the vicinity of the anode surface. Thereby the required high oxidation potential for the process is provided.

There is maintained in the electrolyte a total chloride-ion strength in excess of about 2M. The best result is obtained within the range of 3–5M. When the chloride-ion strength is too low, insufficient lead is dissolved in the electrolyte, resulting in a poorer lead product. In addition, conductivity also becomes excessively low.

The lead leaching and recovery processes are thus carried out in one and the same vessel, electrolytic cell, which is preferably of cylindrical form with electrodes placed radially therein. The cell preferably incorporates a diaphragm which separates the anolyte from the catholyte in a known manner. In order to ensure effective contact between concentrate suspension and anodes, the cell is suitably provided with agitating means which lifts the suspension from the bottom of the cell and transports the same upwardly in the centre of said cell. At the upper part of the cell the suspension is caused to flow outwardly from the cell edge and then obliquely down into contact with or along the vertical anode surfaces. The agitating means can also be arranged to reverse the direction of flow, in which case the suspension is caused to flow outwardly from the cell edge at the bottom of said cell.

The flow of suspension into contact with or along, i.e. closely adjacent, the anode surface is controlled in a manner to maintain the rate of flow at a sufficiently high level over all parts of the anode surfaces present in the cell. This will counteract to a large extent the generation of chlorine gas in the cell. The presence of chlorine gas is liable to cause anode corrosion, and is therefore not desirable.

The oxidation of lead sulphide (PbS) and the oxidation of the $Fe^{2+}$-ions present in the electrolyte takes place at or in the proximity of the anode surfaces. If chlorine gas or oxygen gas is generated in conjunction with the anode reaction, the gas generated will be absorbed effectively by the suspension and remains in the cell, at least to a significant extent.

The maximum current density is dependent on the mass transfer at the anode surface. When the concentrate is forced into contact with the anode surface, as in the case of the present invention, there is also obtained an effective mass transfer through the high flow of suspension over the anode surfaces. The flow is also uniform over the whole of the anode surface.

When, in accordance with the invention, the oxidizing agent, i.e. the electrolyte, is dispersed as uniformly as possible among the particles of concentrate, which is the case in a suspension, it is possible, seen as a whole, to supply a maximum amount of oxidizing agent per unit of time to the lead sulphide while retaining the desired degree of selectivity, which is a great advantage. The method ensures that in this way lead is leached from the solution in the fastest time possible with respect to the kinetics of the dissolution of the lead sulphide.

The method can be carried out in any type of electrowinning cell in which a flow of concentrated suspension can be maintained in the immediate vicinity of the anode or anodes. However, there is preferably used an electrolytic cell of cylindrical construction having a first conical bottom in which the electrodes are placed alternately in a star-shaped formation. The cell incorporates means for guiding the suspension towards and against the anode surfaces, and also an agitating means placed centrally in the cell. The cell is suitably of a construction in which the cathode chambers extend down to the bottom of the cell and through said bottom, beneath which there is arranged a second conical bottom. All lead recovered is collected in this second bottom in the form sponge lead, this lead first forming on the surfaces of the cathode and then falling down gravitationally into the second bottom. The sponge lead can be tapped-off through the cell bottom.

The invention will now be described in more detail with reference to a preferred embodiment of an electrolytic cell illustrated in the accompanying drawing, and also with reference to a working example.

The drawing illustrates schematically a prefered embodiment of an electrolytic cell according to the invention.

Figure 1:
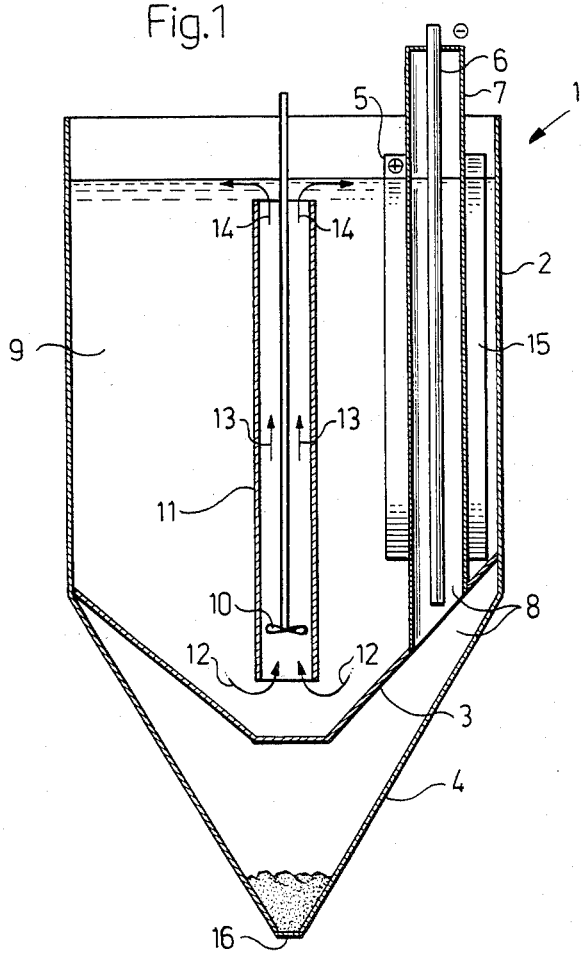
FIG. 1 is a vertical sectional view of the cell.
Figure 2:
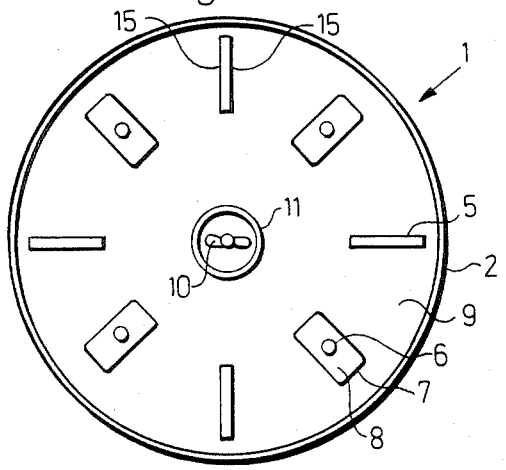
FIG. 2 is a top plan view of the cell.

The cell 1 comprises a vessel 2 having a first conical bottom 3 and a second conical bottom 4 located beneath said first bottom. The cell has electrodes arranged radially therein, i.e. in the form of anodes 5 and cathodes 6. A diaphragm 7 is placed inbetween the electrodes. The cathod chamber 8 is connected directly with the second bottom 4, whereas the anode chamber 9 is connected to the first bottom. The electrolyte present in the anode chamber 9 is referred to as anolyte, and the electrolyte present in the cathode chamber as catholyte. The agitator 10 causes the suspension of concentrate and anolyte to flow into and up through a conduit 11, as shown by arrows 12,13, and then outwardly and downwardly onto the surfaces 15 of the anodes 5, as shown by the arrows 14.

Subsequent to passing the diaphragm 7, the lead ions formed in the anodic reaction precipitate onto the cathodes 6, from which lead metal falls progressively in the form of sponge lead, to be collected in the lowermost conical bottom 4. The sponge lead can then be removed through the apex of the conical bottom 4 with the aid of means 16 intended herefor.

Example 2.5 kg of sulphidic copper-lead concentrate containing, inter alia, 7.5% zinc, 11.8% copper, 17.1% iron (Fe) and 18.0% lead were slurried to form 20 liters of suspension, which was charged to an electrolytic cell of the kind illustrated in the drawing. The anodic current density was maintained at 300 A/m$^2$ at a current of 14 A. The electrolyte contained 250 g NaCl/l and had a pH ranging from 2.8–2.1. The temperature of the electrolyte during the experiment was 90° C. The results obtained are shown in the Tables 1 and 2 below.

| | Anolyte analysis | | | | |
|---|---|---|---|---|---|
| Time h | Ag mg/l | Cu mg/l | Fe g/l | Zn g/l | Pb g/l |
| 0 | 8 | 3 | 23 | 8.8 | 25 |
| 1.5 | 7 | 4 | 19 | 7.3 | 22 |
| 3 | 6 | 4 | 21 | 8.0 | 22 |
| 4.5 | 7 | 4 | 19 | 7.3 | 22 |
| 8 | 7 | 4 | 20 | 7.7 | 21 |

TABLE 2

| | Analyses of leaching residues | | | | |
|---|---|---|---|---|---|
| Time h | Ag g/t | Cu % | Fe % | Zn % | Pb % |
| 0 | 3160 | 11.7 | 16.9 | 7.5 | 18.5 |
| 1.5 | 3436 | 12.2 | 17.9 | 7.9 | 14.8 |
| 3 | 3381 | 12.6 | 18.5 | 8.2 | 13.1 |
| 4.5 | 3421 | 13.1 | 19.2 | 8.3 | 11.4 |
| 6 | 3573 | 13.5 | 19.8 | 8.6 | 8.3 |

We claim:

1. A method for selectively recovering lead from a complex lead-containing sulphidic concentrate in a electrolytic cell comprised of at least one anode and at least one cathode and an electrolyte containing chloride ions, the method being conducted at a temperature beneath the boiling point of the concentrate-containing electrolyte and at a pH of less than 7 and comprising the steps of:

(a) forming a suspension of the concentrate in an electrolyte having a chloride concentration of greater than about 2 molar;

(b) agitating the suspension so as to cause the suspension to flow into contact with or closely adjacent to the surfaces of said at least one anode; and (c) maintaining the anodic current density at a high level in the range of from about 200 to about 400 A/m$^2$ to convert sulphur from the concentrate into elemental sulphur and to precipitate selectively lead at the cathode in the absence of chloride gas emission from the electrolytic cell.

2. The method of claim 1 wherein the chloride concentration is in the range of from 3 to 5 molar.

3. The method of claim 1 wherein the anode current density is in the range of from about 200 to 300 A/m$^2$.

* * * * *